US005154134A

United States Patent [19]

Goldsmith

[11] Patent Number: 5,154,134

[45] Date of Patent: Oct. 13, 1992

[54] ADJUSTABLE SEAT FOR INFLATABLE BOAT HAVING OUTBOARD MOTOR

[75] Inventor: Howard G. Goldsmith, Cranston, R.I.

[73] Assignee: Todd Enterprises, Inc., Cranston, R.I.

[21] Appl. No.: 754,547

[22] Filed: Sep. 4, 1991

[51] Int. Cl.[5] ..... B63B 7/08

[52] U.S. Cl. ..... 114/345; 114/363

[58] Field of Search ..... 114/345, 363; 297/217

[56] References Cited

U.S. PATENT DOCUMENTS 2,989,115 6/1961 Egles ..... 114/363

4,773,709 9/1988 Slinkard ..... 114/363

4,909,177 3/1990 Jones ..... 114/363

*Primary Examiner*—Sherman D. Basinger

*Assistant Examiner*—Thomas J. Brahan

*Attorney, Agent, or Firm*—Salter, Michaelson & Benson

[57] ABSTRACT

A seat for an inflatable boat having an outboard motor, comprising a plurality of telescoping sections movable with respect to each other to permit adjustment of the overall width of the seat, one of said sections comprising a hollow container for storing fuel for the boat's motor.

4 Claims, 3 Drawing Sheets

ADJUSTABLE SEAT FOR INFLATABLE BOAT HAVING OUTBOARD MOTOR

BACKGROUND AND SUMMARY OF THE INVENTION

This invention relates generally to inflatable boats, and particularly boats having outboard motors. The invention more specifically involves a new and improved adjustable seat for such boats.

Inflatable boats have been becoming increasingly popular, primarily for recreational purposes, and also for use as dinghies for transportation purposes. Such boats are advantageous because they are of relatively light weight, thus facilitating transporting thereof, and when deflated, such boats can be folded for more convenient storage. Also, inflatable boats are relatively simply and inexpensive to manufacture and hence are more economically feasible to the consumer.

Although some inflatable boats are not used with outboard motors, many of them are, and this invention is directed to such boats where outboard motors are utilized.

The basic problems with inflatable boats o this type has involved the provision of secure seating in the boat, i.e., a seat which can extend transversely of the boat at any desired location, and which is easy to install. In addition to ease of installation, it is desirable that the overall width of the seat be adjustable so as to be usable with boats having different widths. A second problem which exists in boats of this type where the boat is utilized with an outboard motor involves storage of the fuel for the motor. The fuel is traditionally stored in a container having a supply port to which a flexible tube or hose is connected, the other end thereof being connected to the motor to introduce fuel thereto. Problems have arisen where the fuel storage container is simply positioned on the bottom of the boat, because it may bounce around when the water is rough, thus creating a safety hazard. Even where the storage container is somehow fastened or secured to the boat interior, it is awkward and space consuming, particularly since inflatable boats are relatively small and have limited area therein for the occupants of the boat.

U.S. Pat. #4,909,177, issued on Mar. 20, 1990 to Robert S. Jones, deals with the problem of providing a seat for inflatable boats, but is not concerned with inflatable boats where an outboard motor is being used. In the Jones patent, a seat is provided having an elongated planar surface with arcuate end panels for snugly engaging the rounded configuration of the tubular side walls of the boat. It will be obvious, however, that the seat in the Jones patent is not adjustable for different-size boats and would be difficult to install and/or move to different locations in the boat when the latter is fully inflated.

The present invention deals with the problem of fuel storage and the desirability of providing a adjustable seat by combining the fuel storage container as a part of the seat structure. More specifically, the seat of the present invention comprises a plurality of telescoping sections movable with respect to each other to permit adjustment of the overall width of the seat. One of the sections is actually the fuel storage container, thus automatically solving the two problems discussed above, namely, secure mounting of the container within the boat, and minimizing the loss of space in the boat normally occasioned by having to place the fuel storage container therein. The adjustability of the seat enables it to be easily mounted because the sections can be collapsed to a width less than the width of the boat, placed at their desired location, and then expanded to be securely positioned at said desired location. Locking means is also provided which, when released, permit the sections to slidably move with respect to each other, but which when tightened, securely retain the sections in their desired relative position.

It is therefore a primary object of this invention to provide an adjustable seat for an inflatable boat utilizing an outboard motor, said seat comprising as a part thereof the fuel storage container for the motor.

Another object is the provision of an adjustable seat for inflatable boats comprising a plurality of telescoping sections, whereby the seat may be collapsed for easy installation within the boat at any desired location, and then expanded to securely mount and maintain the seat at its desired position relative to the boat.

A further object is the provision of an adjustable seat for inflatable boats that is relatively simple and inexpensive to manufacture, durable and effective in use, and economically feasible to the consumer.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED FORM OF THE INVENTION

Figure 1:
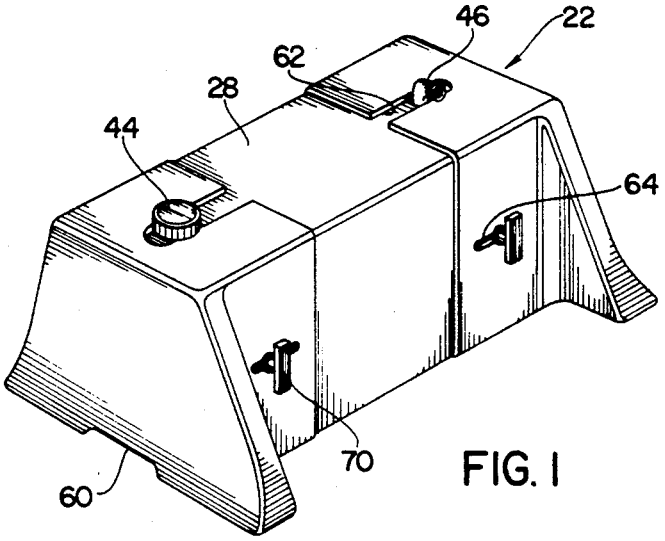
FIG. 1 is a perspective view of the adjustable seat of my invention shown in assembled relation.
Figure 2:
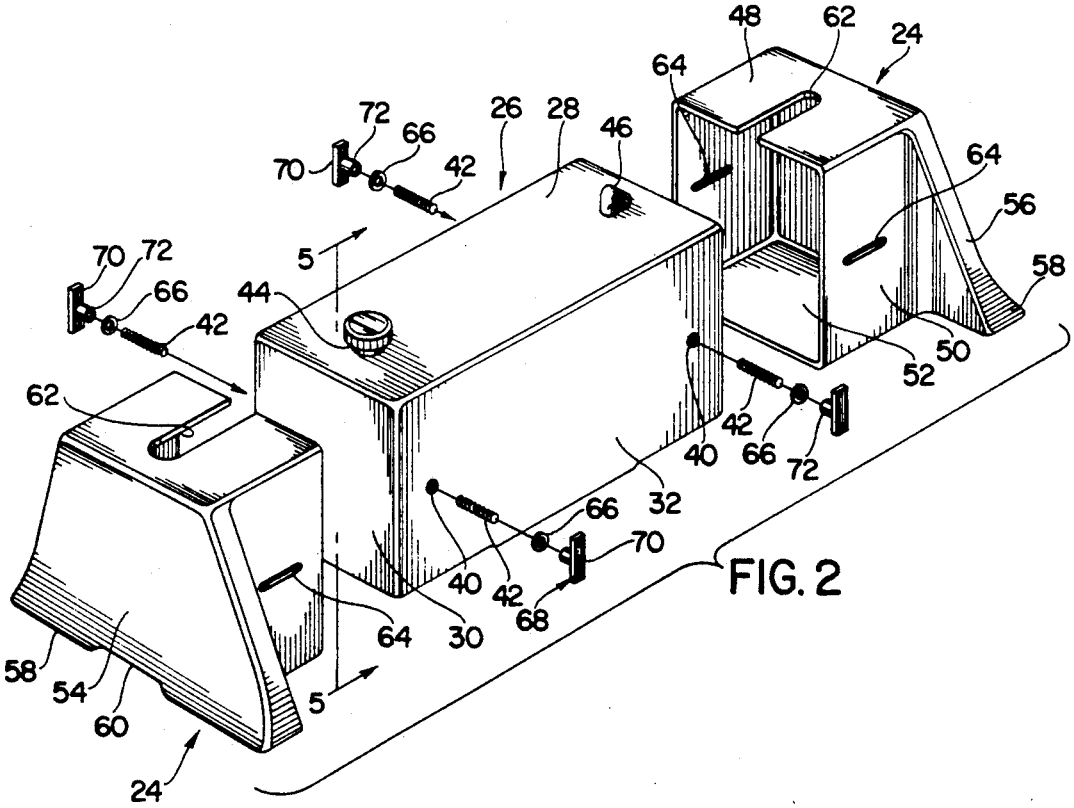
FIG. 2 is an exploded perspective view thereof.
Figure 3:
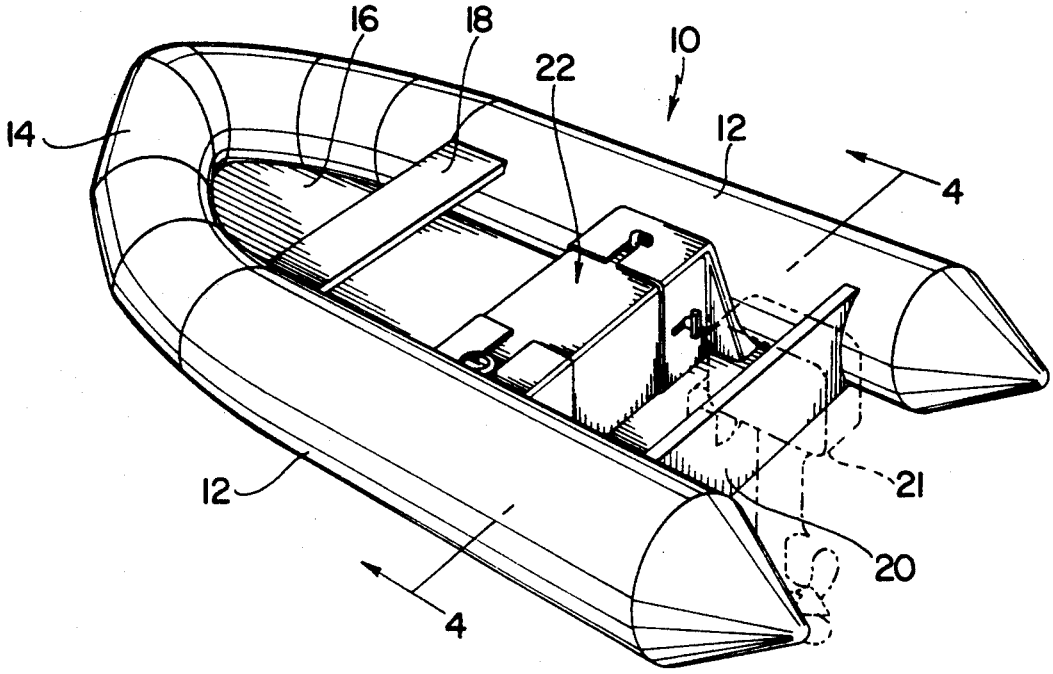
FIG. 3 is a perspective view showing the seat of FIG. 1 installed in an inflatable boat.
Figure 4:
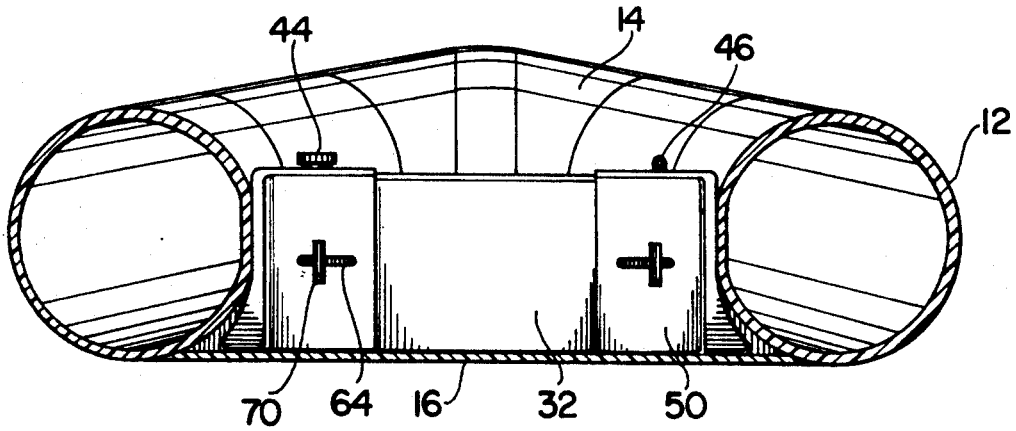
FIG. 4 is a section taken on line 4—4 of FIG. 1.

Referring now to the drawings, and particularly FIGS. 1 through 3 thereof, there is shown generally at 10 in FIG. 3 an inflatable boat of generally conventional construction comprising tubular side walls 12 interconnected by a tubular bow section 14, a bottom wall 16, a bench seat 18 located adjacent the forward end of the boat, and a transom 20. An outboard motor 21 may be mounted on transom 20 by conventional mounting means. The adjustable seat that embodies the present invention is shown generally at 22.

Figure 5:
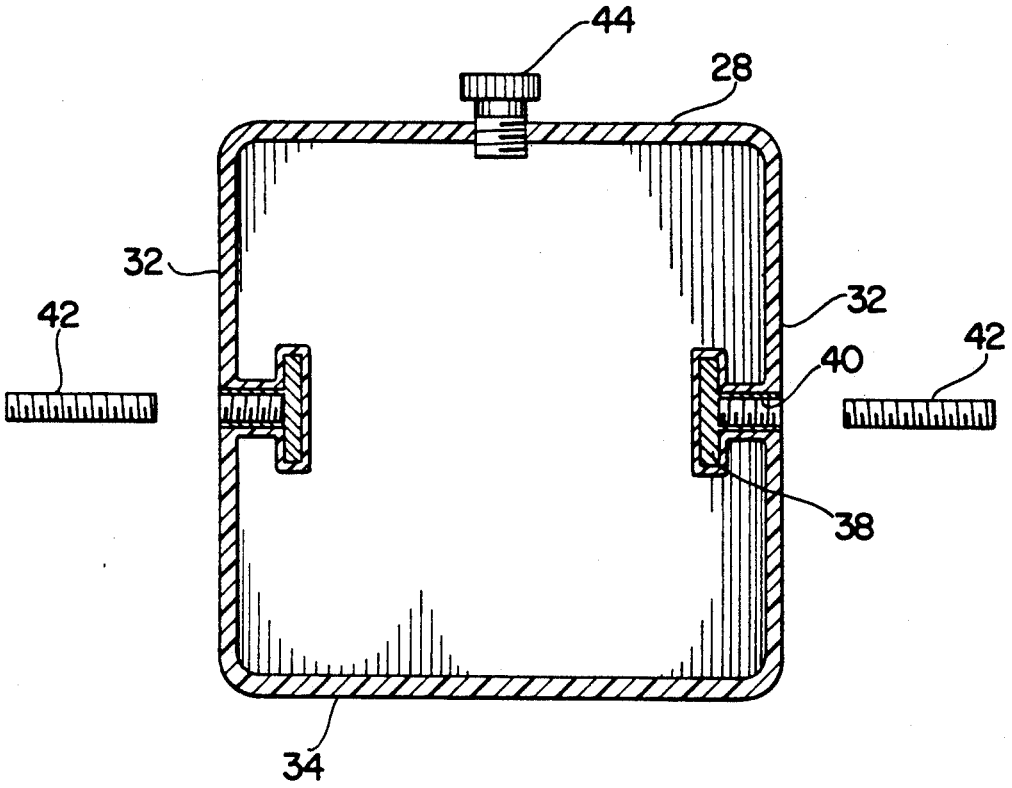
FIG. 5 is a section taken on line 5—5 of FIG. 2.
Figure 6:
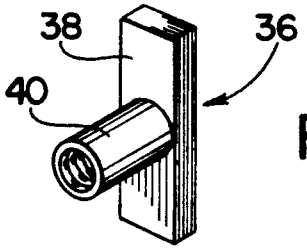
FIG. 6 is a perspective view of the T-nut that is encapsulated within the fuel storage container shown in FIG. 5.

As Will be seen most clearly in FIGS. 1 and 2, adjustable seat 22 comprises identical end sections shown generally at 24, and a center section shown generally at 26. Center section 26 is an elongated rectangular container comprising top wall 28, end walls 30, side walls 32, and bottom wall 34. The center section or container 26 functions as a storage container for fuel for the outboard motor 21, and is preferably molded of any suitable plastic, such as cross-linked polyethylene. As will be seen most clearly in FIG. 5, the side walls 32, adjacent opposite ends thereof, are provided with T-nuts 36 (FIG. 6) comprising an elongated head portion 38 and an internally threaded tubular portion 40 that extends therefrom. As will be seen most clearly in FIG. 5, the T-nuts 36 are formed as an integral part of container 28 during the molding of the latter, so as to preserve the integrity of container 26 to prevent any leakage therefrom. Threaded studs 42 are threadedly engaged within threaded tubular portions 40, and preferably lock-threads are utilized so that once the threaded studs 42 are threaded into the tubular portions 40, they are prevented from being threadedly removed. Top wall 28 of container 26 is provided with an inlet cap 44 to permit fuel to be introduced into the container, said cap preferably comprising gage means as a part thereof to generally indicate the level of fuel within the container. Top wall 28 also carries a supply port 46 comprising a right-angle tube, said supply port being adapted to receive a flexible tube or hose (not shown) that permits fuel to be communicated from container 26 to the outboard motor 21.

End sections 24, also preferably molded of cross-linked polyethylene or the like, are of generally square configuration having an open inner end and comprising top wall 48, side walls 50, bottom wall 52, and end wall 54. As will be seen, end walls 54 preferably flare outwardly as at 56 to increase the bearing surface between said end walls and the tubular side walls 12 of the inflatable boat 10, said end walls being further characterized by outwardly 18 extending portions 58 at their bottom extremities, the purpose of which will hereinafter become apparent. To facilitate gripping of the assembled seat 22, cutouts 60 are provided adjacent the lower edges of end walls 54.

It will be understood that the end sections 24 are dimensioned so as to snugly and slidably receive center section 26 in telescoping relation. In order to accommodate inlet cap 44 and supply port 46 when the sections are telescopingly assembled, slots 62 are provided on top surfaces 48 of the end sections, said slots extending outwardly from the inner edge of top wall 48. FIGS. 1 and 3 show the sections in assembled relation with the inlet cap 44 and supply port 46 positioned within slots 62. Side walls 50 of the end sections are each provided with elongated slots 64 which are aligned with the outer end of internally threaded tubular portions 40. Thus, when it is desired to assemble the sections 24 and 26, the opposite ends of the latter are slidably received within the open ends of the former, with the inlet cap 44 and supply port 46 each being received within the adjacent slots 62. When the desired relative positioning of end sections 24 and center section 26 has been determined, the threaded studs 42 are inserted through slots 64 into threaded engagement with internally threaded tubular portions 40, it being understood that the studs 42 will extend outwardly from side walls 32, but relative sliding movement between end sections 24 and center section 26 will still be permitted, limited only by the length of the slots 64. Once the sections are in their desired adjusted position, washers 66 are slidably positioned on the outwardly extending studs 42, and then pressure members 68 comprising an elongated handle 70 and an internally threaded hub 72 are threaded onto the free outer ends of studs 42 and tightened until washers 66 make firm and secure frictional engagement with side walls 50 to securely maintain the end sections 24 in their desired adjusted relationship with center section 26.

When it is desired to mount the seat 22 in inflatable boat 10, the former is first assembled so that end sections 24 are in slidable telescoping relation with center section 26, as illustrated in FIG. 1. The pressure members 68 are threadedly engaged with studs 42 but are not tightened, so that end sections 24 may be slidably moved relative to center section 26. The seat 22 is then positioned on bottom wall 16 of boat 10 at the desired location within the boat 10, it being understood that during the initial assembly, the seat 22 has been collapsed sufficiently so that the overall width of same is less than the width between opposed tubular wall portions 12 whereby the assembled seat 22 may be easily placed therebetween. Once the seat 22 has been placed in its desired position, the end sections 24 are slidably moved in an outward direction until end walls 54 make snug pressurized engagement with the inner surfaces of tubular wall portions 12, and at the same time the outward extensions 58 at the bottom of end walls 54 will wedgingly engage beneath tubular wall portions 12 to securely maintain the seat 22 against upward movement. At this time the pressure members 68 are tightened to secure and maintain the proper overall width of the seat 12. Thus, the center section 26 simultaneously functions as a storage container for fuel for the outboard motor of the boat and as the center section of the seat 22. This results in an obvious space saving in the relatively small boat 10 and at the same time provides an adjustable seat that can be easily installed when the boat is fully inflated, and can be easily removed or relocated within the boat, while the boat is fully inflated.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A seat for an inflatable boat of the type having a bottom wall and spaced tubular side walls, and further having an outboard motor, comprising:

(a) three telescoping sections positioned on said bottom wall and movable with respect to each other to permit adjustment of the overall width of the seat so that the seat may be adjusted to enable the opposite extremities thereof to snugly engage the inner surfaces of the spaced side walls, (b) the center of the three sections comprising a hollow rectangular container for storing fuel for the boat's motor, (c) the two end sections having an open inner ends and being dimensioned so as to snugly and slidably receive the opposite ends of said center section in telescoping relation, and (d) means for maintaining said sections in their adjusted position.

2. The seat of claim 1 further characterized in that said maintaining means comprise a pair of threaded studs extending outwardly from a side wall of said center section, said studs being located adjacent to but spaced from the opposite ends of said center section, elongated slots extending parallel to said bottom wall and located on the adjacent side walls of said end sections, said studs extending through said slots, and pressure members threadedly attached to said studs, whereby tightening of said members results in pressure being exerted against the outer surfaces of said end sections to prevent further sliding movement between said end sections and said center section.

3. The seat of claim 1 further characterized in that the top wall of said center section has an upwardly extending inlet cap adjacent one end, and an upwardly extending supply port adjacent the opposite end thereof, and slots extending from the inner edges of the top walls of said end sections for receiving said cap and port when said end and center sections are in telescoping relation.

4. A seat for an inflatable boat of the type having a bottom wall and spaced tubular side walls, and further having an outboard motor, comprising:

(a) a plurality of telescoping sections positioned on said bottom wall and movable with respect to each other to permit adjustment of the overall width of the seat so that the seat may be adjusted to enable the opposite extremities thereof to snugly engage the inner surfaces of the spaced side walls, (b) one of said sections comprising a rectangular hollow container for storing fuel for the boat's motor, (c) the section adjacent to said hollow container having an open end that is dimensioned so as to snugly and slidably receive the adjacent end of said hollow container in telescoping relation, and (d) means for maintaining said sections in their adjusted position.

* * * * *